US007673748B2

(12) United States Patent
Norell

(10) Patent No.: US 7,673,748 B2
(45) Date of Patent: Mar. 9, 2010

(54) PACKAGE FOR CONTAINING AND DISPLAYING ELONGATE ARTICLES

(75) Inventor: Gregory B. Norell, Mays Landing, NJ (US)

(73) Assignee: Norell, Inc., Landisville, NJ (US)

( * ) Notice: Subject to any disclaimer, the term of this patent is extended or adjusted under 35 U.S.C. 154(b) by 252 days.

(21) Appl. No.: 11/689,082

(22) Filed: Mar. 21, 2007

(65) Prior Publication Data

US 2008/0230425 A1 Sep. 25, 2008

(51) Int. Cl.
*B65D 85/20* (2006.01)

(52) U.S. Cl. ..... 206/443; 206/45.2; 206/45.23; 220/812; 220/813

(58) Field of Classification Search ..... 206/443, 206/467, 468, 569, 45.23, 267, 270; 220/812, 220/813, 375, 345.1, 351, 345.4, 345.3, 259.5; 229/129.1, 220, 125.08
See application file for complete search history.

(56) References Cited

U.S. PATENT DOCUMENTS 1,033,526 A * 7/1912 Boye ..... 220/523
1,328,672 A * 1/1920 Hirsohn ..... 220/811
1,720,274 A * 7/1929 Holden ..... 206/755
2,450,089 A * 9/1948 Hergesell et al. ..... 206/306
2,547,353 A * 4/1951 Wiinikka ..... 220/375
2,577,862 A 12/1951 Shaw, Jr.
2,597,810 A * 5/1952 Myers ..... 229/129.1
3,977,520 A 8/1976 Grimm
4,056,047 A 11/1977 Grimm
4,186,835 A * 2/1980 Hofer ..... 206/443
4,538,731 A * 9/1985 Cillario ..... 206/540
4,671,449 A * 6/1987 Fronduti ..... 229/129.1
5,038,932 A * 8/1991 Sheu ..... 206/387.1
5,183,542 A * 2/1993 Jackovitz et al. ..... 204/451
6,168,020 B1 1/2001 Niedzwiedz

* cited by examiner

*Primary Examiner*—Ehud Gartenberg
*Assistant Examiner*—Blaine G Neway
(74) *Attorney, Agent, or Firm*—Diehl Servilla LLC; Glen M. Diehl; Jeffrey I. Blankman

(57) ABSTRACT

A package for containing and displaying elongate articles includes an elongate receptacle with an open end and a closed end. The receptacle has a sleeve disposed and sized for slidable movement over a portion of the elongate receptacle. The sleeve has an open end portion and a closed end portion that are connected by a hinge. The sleeve is disposed on the elongate receptacle and slidably moveable from a first position wherein the closed end of the sleeve substantially obstructs the open end of the receptacle, a second position wherein the hinge is disposed beyond the open end of the receptacle and the closed end portion of the sleeve is selectively moveable about the hinge so that when the open end portion of the sleeve is slidably returned toward the first position the closed end portion of the sleeve engages an outside surface of the elongate portion thereby forming a projection, so that when the package is placed on a horizontal surface so that the closed end of the receptacle and the sleeve closed end engage the horizontal surface, the open end of the receptacle is elevated above the closed end of the receptacle, thereby displaying and improving the accessibility of the elongate articles being contained within the receptacle.

20 Claims, 8 Drawing Sheets

PACKAGE FOR CONTAINING AND DISPLAYING ELONGATE ARTICLES

FIELD OF INVENTION

The present invention is generally related to packages for articles and more particularly to a package with the capability to display the articles therein.

BACKGROUND

Packages are a ubiquitous part of nearly every product sold in this country. Packages serve many purposes for a product. For consumer products, the package provides easy to handle units of products, it protects the product during shipping and handling and attracts the customer's attention to the product.

U.S. Pat. No. 2,577,862 to Shaw discloses dispensing package for articles of an elongated nature. The example is a package for storing and dispensing shoe laces. The disclosure includes a body member which serves as a container for the articles. The body member has a back wall with side walls, but not top walls. The disclosed package includes a second member having both back and front walls as well as side walls which is disposed to telescope over the body member so as to form a closure for the contents. The cover member is in effect cut away at its lower corners so as to expose the articles, enabling them to be withdrawn from the package, and when the package is in a substantially vertical position the other articles will move by gravity downwardly so that as one is withdrawn a fresh one slides itself into location to be withdrawn.

U.S. Pat. No. 3,977,520 to Grimm discloses a package for housing cigarettes and the like having a sliding sleeve or like member designed to actuate a lid or closure structure, the closure member is easily actuated to and from open and closed positions by means of a simple sliding of a sleeve in a manner reciprocally of the receptacle. In all of the disclosed packages the slidable sleeve is attached to the closure member.

U.S. Pat. No. 4,056,047 to Grimm is an elaboration of the package disclosed in the U.S. Pat. No. 3,977,520 patent that describes the layout, assembly and machinery used to assemble the disclosed package. The Figures and the Description illustrate and describe the bonding of the sliding member to the receptacle.

U.S. Pat. No. 6,168,020 to Niedzwiedz discloses a reclosable sleeve pack for windshield wiper blades. The disclosed package has a sleeve that has an opening at one end which allows the sleeve to slide easily over the container. The sleeve fits over the tab end of the container and covers the opening in the container when the sleeve is in place on the container. The other end of the sleeve contains an enclosure which covers the tab end of the container including a portion of the tab.

While there are many types of packages for elongate objects, there is still a need for a package that can receive and contain elongate fragile objects. If such a package also could function as a display holder to enable a user to easily remove and replace objects from the packaging, the art of packaging would be advanced.

SUMMARY OF THE INVENTION

An embodiment of a package for containing and displaying elongate articles of the present invention includes an elongate receptacle with an open end and a closed end. The receptacle has a sleeve disposed and sized for slidable movement over a portion of the elongate receptacle. The sleeve has an open end portion and a closed end portion that are connected by a hinge. The sleeve is disposed on the elongate receptacle and slidably moveable between a first position wherein the closed end of the sleeve substantially obstructs the open end of the receptacle and a second position wherein the hinge is disposed adjacent the open end of the receptacle. The closed end portion of the sleeve being selectively sufficiently moveable about the hinge from the axis of the elongate receptacle so that when the open end portion of the sleeve is slidably returned toward the first position wherein the hinge is between the open and the closed end of the receptacle and the closed end portion of the sleeve having been sufficiently moved out of the axis of the receptacle, the closed end portion of the sleeve engages an outside surface of the elongate portion thereby forming a projection, so that when the package is placed on a horizontal surface so that the closed end of the receptacle and the sleeve closed end engage the horizontal surface, the open end of the receptacle is elevated above the closed end of the receptacle, thereby displaying and improving the accessibility of the elongate articles being contained within the receptacle. In one embodiment of the invention, the articles in the package are a plurality of NMR sample tubes, wherein all of the tubes are oriented with their open ends in the same direction.

DETAILED DESCRIPTION

Figure 1B:
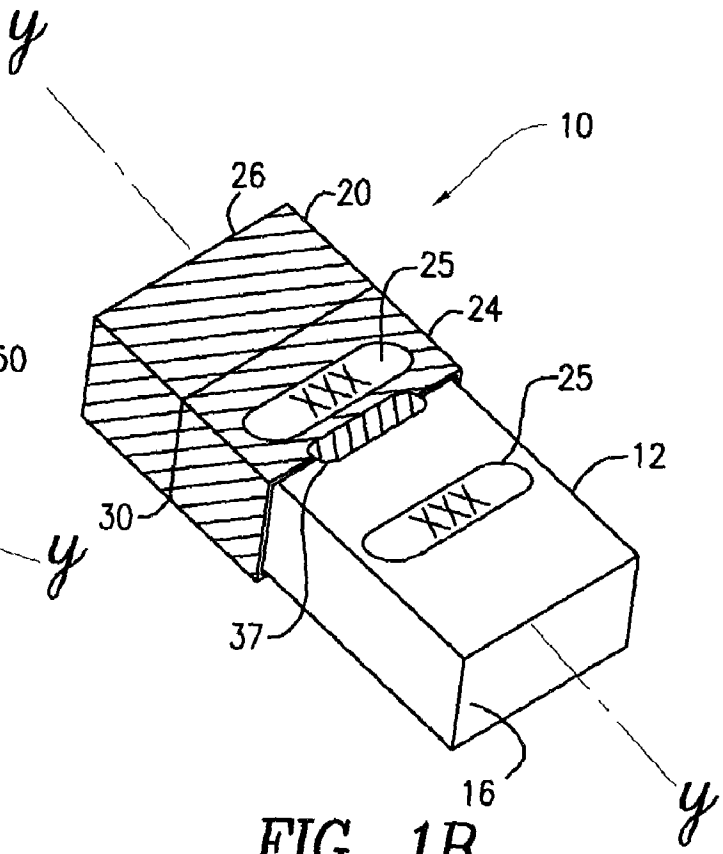
FIG. 1B is a perspective view of the package of the invention with the open end of the receptacle obstructed by the closed end portion of the sleeve.

While this invention is satisfied by embodiments in many different forms, there are shown in the drawings and herein described in detail, embodiments of the invention with the understanding that the present disclosure to be considered as exemplary of the principles of the present invention and is not intended to limit the scope of the invention to the embodiments illustrated. The scope of the invention is defined in the claims.

As illustrated in FIGS. 1-6, an embodiment of package 10 of the present invention for containing and displaying elongate articles includes an elongate receptacle 12 with an open end 14 and a closed end 16. The embodiment also includes a sleeve or a cover 20 disposed and sized for slidable movement over a portion 22 of elongate receptacle 12. Sleeve 20 has an open end portion 24 and a closed end portion 26. Portions 24 and 26 are connected by a hinge 30. Sleeve 20 is disposed on the elongate receptacle and slidably moveable, indicated by the arrows best seen in FIG. 2. Sleeve 20 is slidably movable from a first position, best seen in FIG. 1B, wherein closed end portion 26 of sleeve 20 substantially obstructs open end 14 of receptacle 12, to a second position, best seen in FIG. 2, wherein hinge 30 is disposed adjacent open end 14 of receptacle 12. Closed end portion 26 of the sleeve is selectively sufficiently moveable about hinge 30 from a position of substantial congruency to a longitudinal axis Y of elongate receptacle 12.

When open end portion 24 of the sleeve is slidably returned toward the first position wherein hinge 30 is between the open and the closed end of the receptacle and closed end portion 26 of the sleeve having been sufficiently moved out of axis Y of the receptacle, closed end portion 26 of the sleeve engages an outside surface 34 of elongate receptacle 12 thereby forming a projection 40. When package 10 is placed on a horizontal surface 50, best seen in FIG. 1A so that closed end 16 of the receptacle and sleeve closed end 26 away from hinge 30 engage horizontal surface 50, open end 14 of the receptacle is elevated above closed end 16 of the receptacle, thereby displaying and improving the accessibility of an elongate article 60 being contained within the receptacle.

Figure 1A:
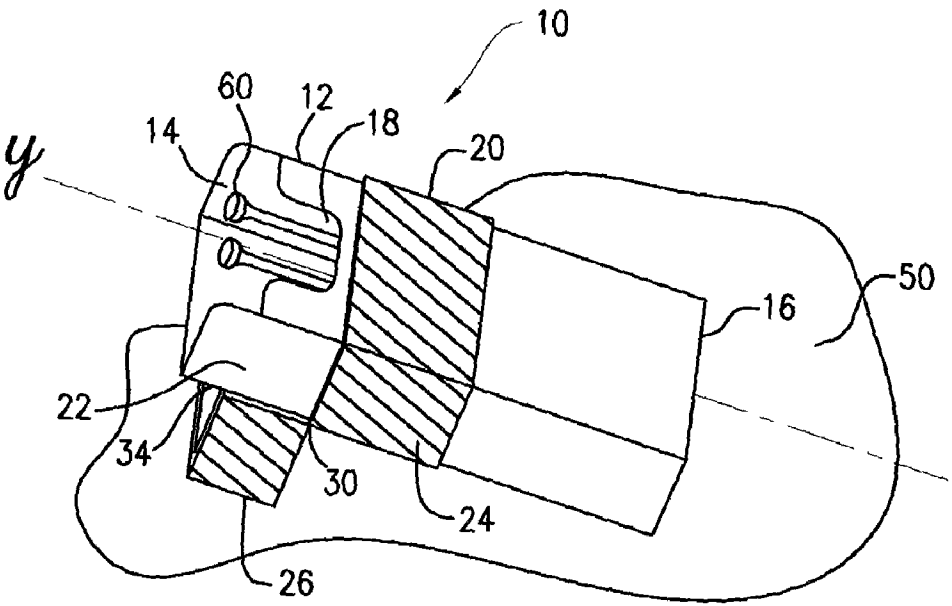
FIG. 1A is a perspective view of the package of the invention with the open end of the receptacle elevated above a horizontal surface by the closed end portion of the sleeve.
Figure 2:
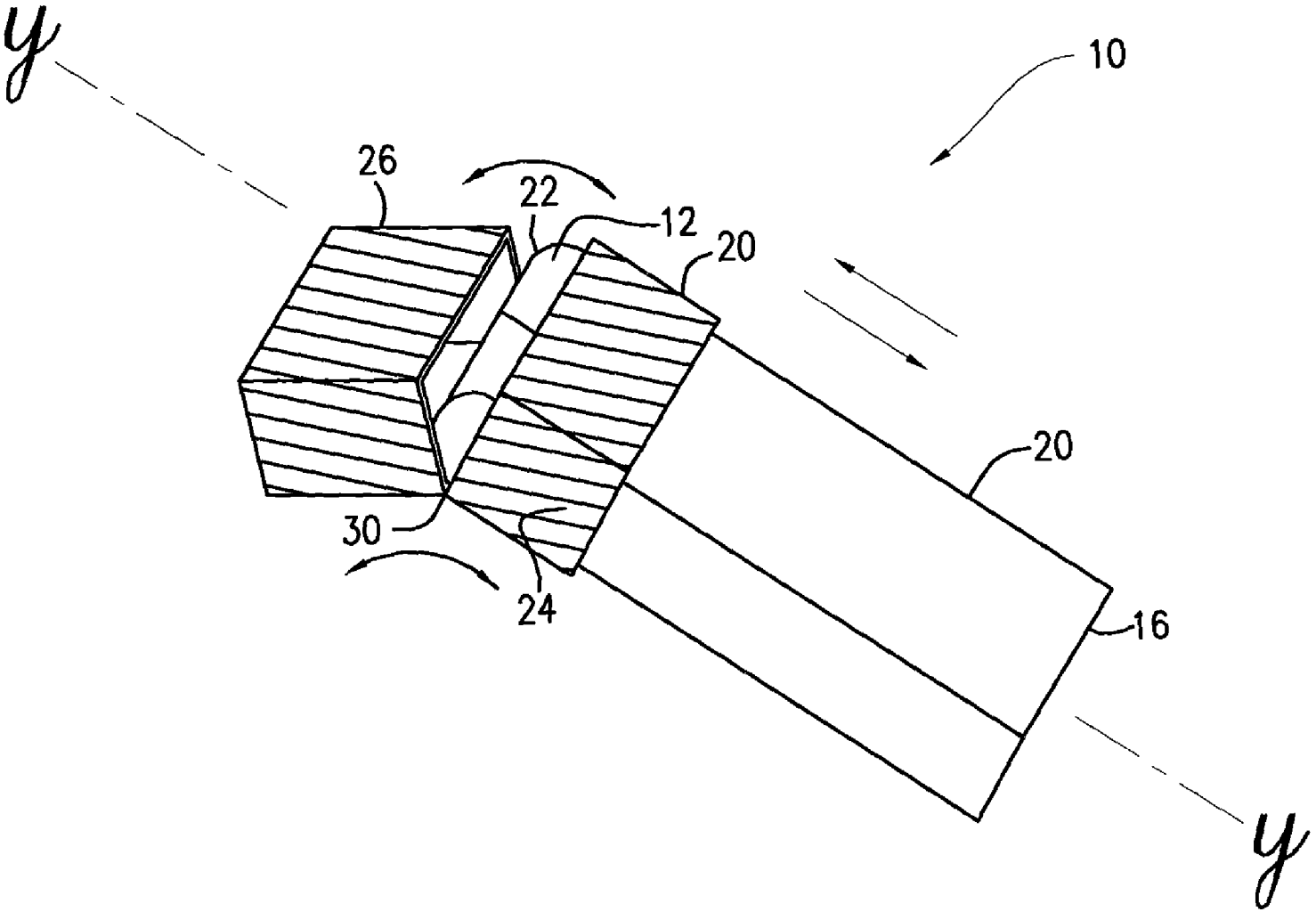
FIG. 2 is a perspective view of the package of the invention with illustrating the closed end portion of the sleeve part-way between the position, illustrated in FIG. 1B, wherein the open end of the receptacle is obstructed, to the position of FIG. 1A wherein the closed end of the sleeve serves to elevate the open end of the receptacle.

Package 10 is reversibly closable to the state shown in FIG. 1B from the open position as shown in FIG. 1A by the slidable movement of sleeve 20 from the position wherein closed end portion 26 of the sleeve engages the outside surface of the receptacle to a position wherein hinge 30 is disposed adjacent open end 14 of the receptacle thereby allowing the selective movement of closed end portion 26 of the sleeve to a position substantially congruent with axis Y of the elongate portion, so that a selective slidable movement, as illustrated in FIG. 2, of sleeve 20 to the first position thereby closes open end 14 of receptacle 12.

Figure 6B:
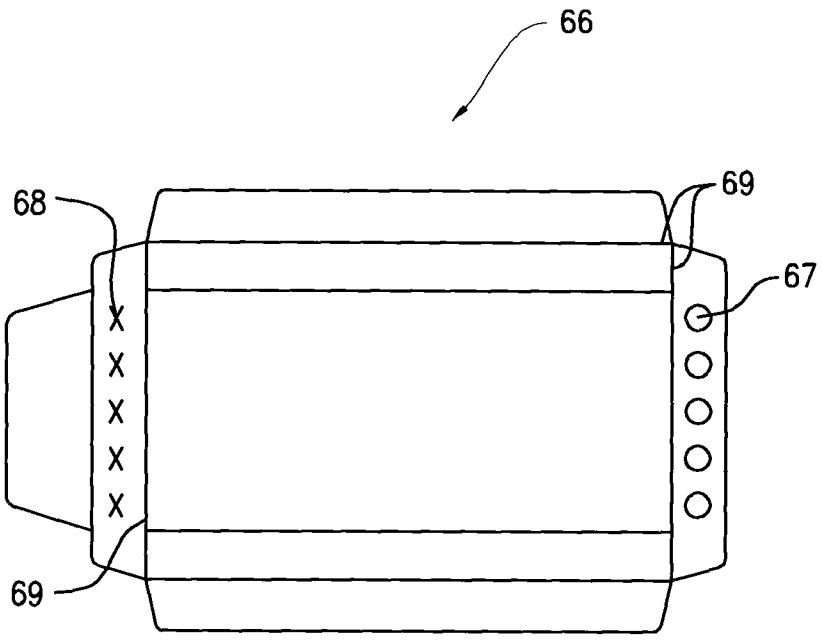
FIG. 6B is a perspective view of another embodiment of an adapter portion, to fit within the receptacle of FIG. 1 for receiving and separately holding elongate articles such as that illustrated in FIG. 5.
Figure 6A:
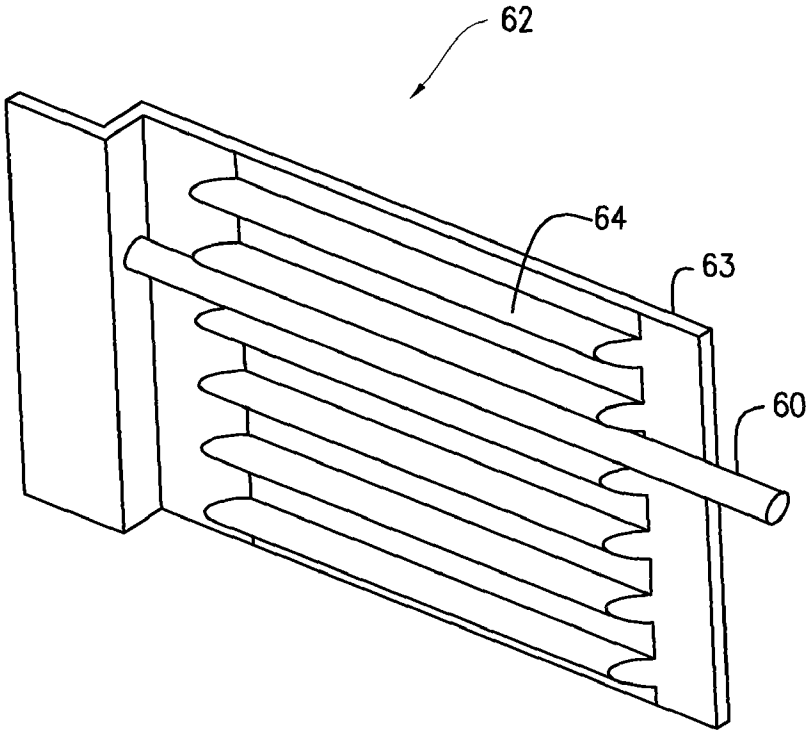
FIG. 6A is a perspective view of an embodiment of an adapter portion, to fit within the receptacle of FIG. 1 for receiving and separately holding elongate articles such as that illustrated in FIG. 5.

In one embodiment, receptacle 12 has an adapter as shown in FIGS. 6A and 6B for receiving and separately holding a plurality of elongate objects. The embodiments illustrated in FIGS. 6A and B serve only as representations of the invention, other variations may be envisioned and should be considered as within the scope of the invention. Adverting to FIG. 6A, an adapter 62 for holding elongate articles 60 may be formed from two sheets, a base sheet 63 having a top sheet 64 folded and glued to form a preselected number of flutes or channels for receiving elongate articles 60. Adverting to another embodiment 66 of the adapter, a sheet may be shaped, and creased to form an adapter with a plurality of openings 67 and/or cuts 68, then folded along the crease lines 69 to fit within receptacle 12. For particular applications, other embodiments may be envisioned where the adapter is formed in two portions which are individually fit within the receptacle. The adapters may be sized and shaped to slidably fit within receptacle 12 or they may be bonded by an adhesive, fasteners, interlocking perforations or combinations thereof and the like. The adapters may be formed from materials that are the same or different than the slide or the receptacle. Alternatively they may be formed from a foamed material or pressed cellulosic materials. For particular applications, the elongate objects may be bundled in an over-wrap that is sized to fit within receptacle 12 without an adapter and a separate additional package that is also sized to fit within receptacle 12 along with the bundle may be used to contain accessories for the elongate articles such as caps, labels and the like.

In one embodiment, receptacle 12 and sleeve 20 have a substantially rectangular shape. Other shapes such as round, square or oval may be suitable for particular requirements and are considered within the scope of the invention.

Embodiments of receptacle 12 and sleeve 20 may be formed from the same or different materials. Suitable materials include, but are not limited to polymeric materials, cellulosic materials, metallic foils, and composites formed from these materials. In one embodiment, each of receptacle 12 and sleeve 20 are formed from a solid bleached sulfite (SBS) linerboard, this material is generally clay coated for appearance. In one specific embodiment, SBS clay coated liner board with a 0.016 in. thickness was used to form slider 12 and receptacle 14. In an embodiment, as seen in FIG. 6A, of the adapter 62, base sheet 63 was formed from 0.018 in. double white and the fluted top sheet 64 was formed from 0.007 in. white lined Kraft that was folded and glued to base sheet 63. For particular applications and depending on the materials selected, other thickness materials may be used and are to be considered within the scope of the invention. In another specific embodiment, as illustrated in FIG. 6B, the adapter is formed from SBS linerboard cut to a preselected shape, creased, folded and fitted with openings or cut-outs sized and aligned to receive and hold the elongate objects and fit within the receptacle. In another embodiment, the adapter may be formed from a resilient foam material that is dimensioned to fit within receptacle 14.

Figure 3:
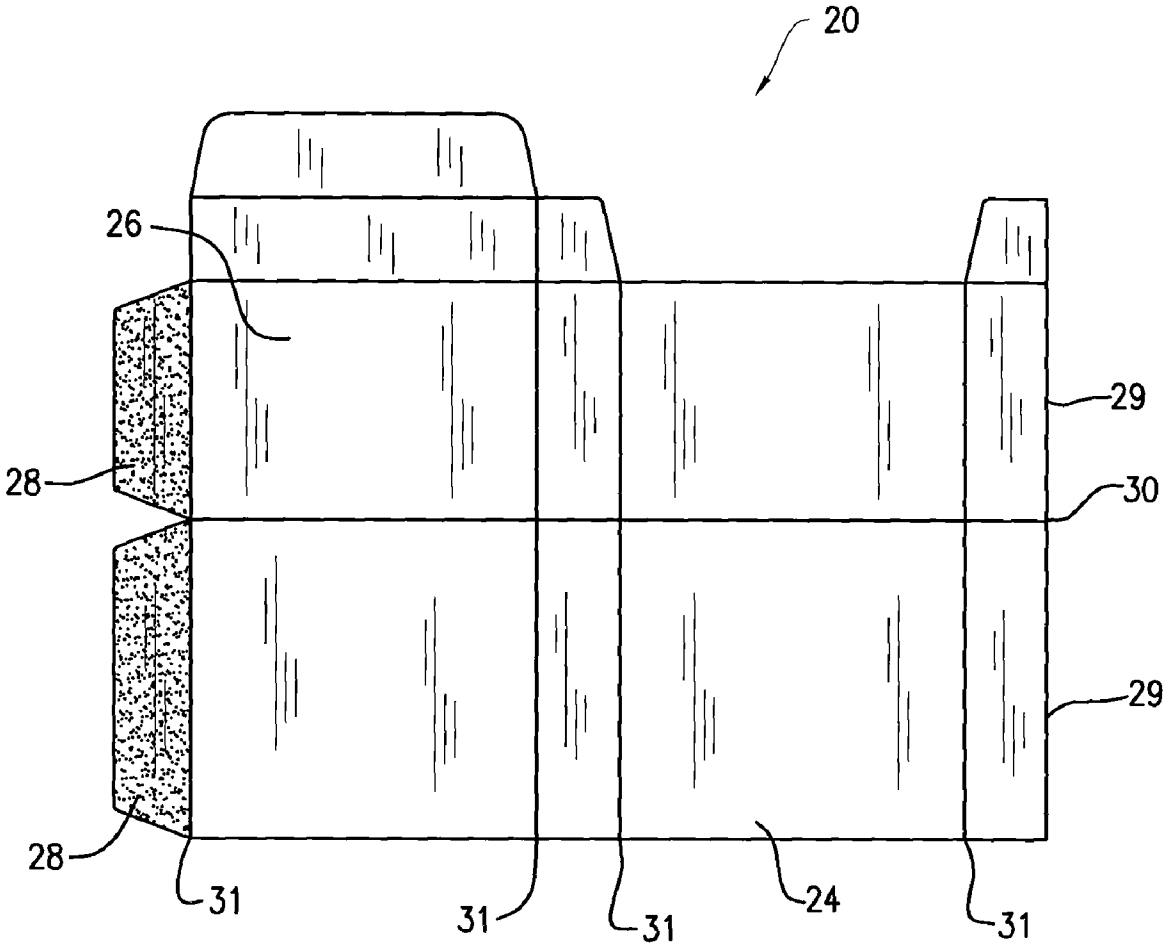
FIG. 3 is a top plan view of the sleeve portion of the package of the invention as cut from a sheet of material before folding.
Figure 4:
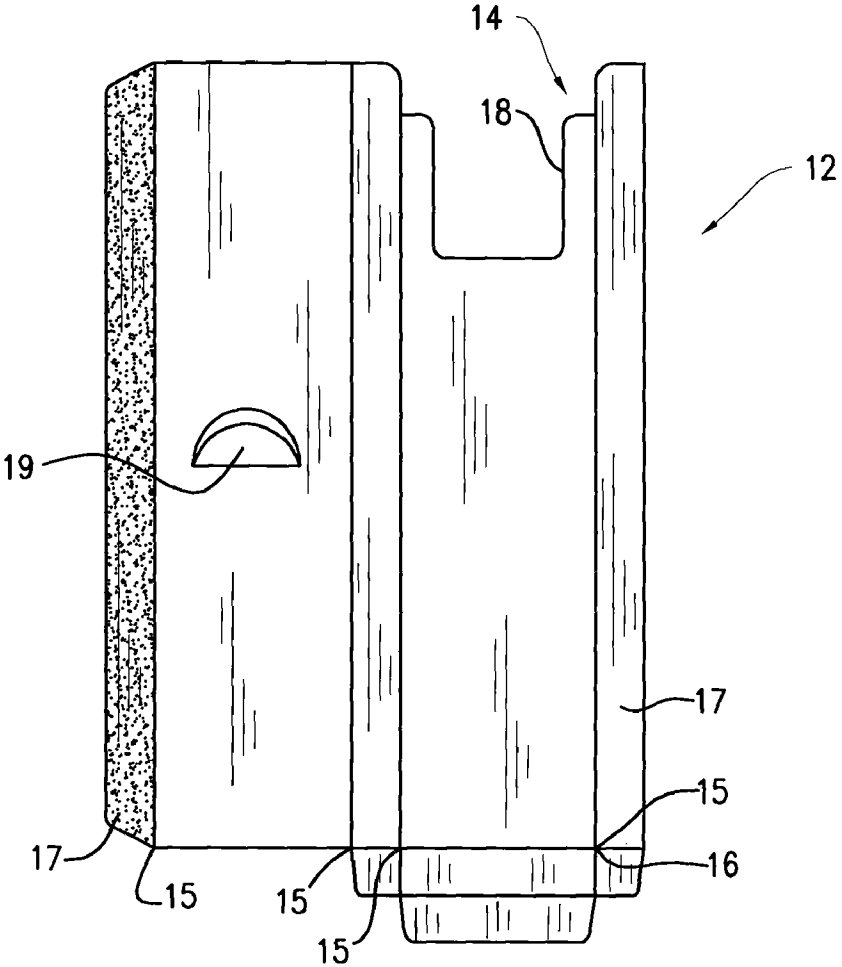
FIG. 4 is a top plan view of the receptacle portion of the package of the invention as cut from a sheet of material before folding.

As shown in FIGS. 3 and 4, the material used for forming receptacle 12 and sleeve 20 may be cut from a sheet. In an embodiment, any desired decoration such as printing, embossing and the like may be performed on the material as an uncut sheet or as on the cut shape. The cut shape may then be creased, folded and bonded into three-dimensional sleeve 12 or receptacle 20. Referring to FIG. 3, sleeve 20 may be formed by bringing together and bonding tabs 28 and 29 by folding the sheet at creases 31. Referring to FIG. 4, receptacle 12 may be formed by folding the sheet at creases 15 and bonding tabs 17. Bonding or attachment may be accomplished by heat or sonic welding, adhesives, fasteners, interlocking perforations and the like, as well as combinations of these bonding techniques depending on the materials selected.

As schematically illustrated in FIG. 1B, one or both of receptacle 12 and sleeve 20 may include decorations 25 such as labels, lithographic printing, jet printing, offset printing, debossing, embossing, foil transfer, die cutting, perforating and combinations thereof in monotone or one or more colors and the like. Decorations 25 may be used to convey information about the contents, use instructions or other identification.

In another embodiment, best seen in FIGS. 1A and 4, receptacle 12 may have a cut-out section 18 to facilitate viewing, removal and replacement of articles 60. Another embodiment, also best seen in FIG. 4, shows a stop 19 shaped and disposed to limit the travel of sleeve 20 toward the closed end of receptacle 12. The placement of stop 19 facilitates the use of package 10 as a display package, by preselecting the location of projection 40 to support the open end of receptacle 12 in an elevated position with respect to the closed end. For particular applications, stop 19 could be located in any position, with more than one occurance and in other forms, besides the cut tab form illustrated, on receptacle 12 where it would limit the travel of sleeve 20 and fall within the scope of the present invention.

Figure 5:
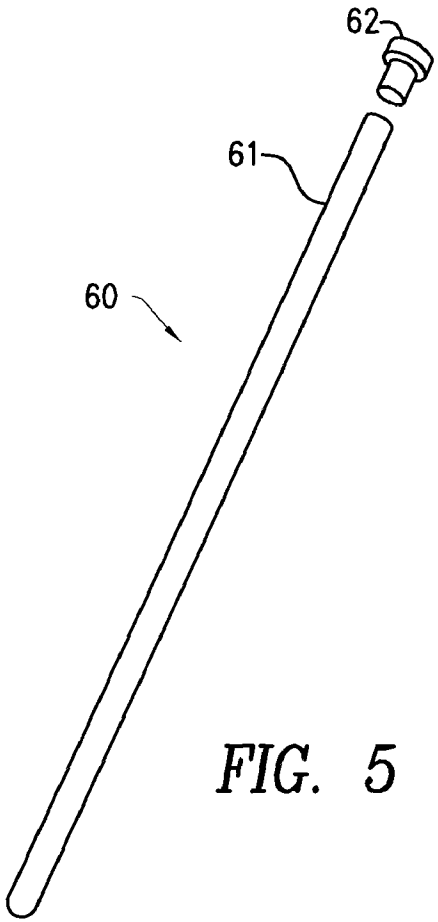
FIG. 5 is an exploded perspective view of an NMR sample tube which an embodiment of the present invention is suitable for holding.

In one embodiment, elongate article 60 may include NMR sample tubes 61 as seen in FIG. 5, these tubes are generally available in several sizes, ranging from 1 mm diameter×4.25 in. long, 5 mm diameter×7 or 8 in. long to 10 mm diameter×7 in. long. These tubes are generally formed from glass of precise dimensions with thin walls and generally have a cap 62. Package 10 of the invention is well-suited to receive and store such items.

For particular applications, package 10 may incorporate tamper evident closures, such as a frangible seal 37 and the like. Tamper evidence may also be accomplished by other overwrap, polymeric tape seals, foil tape seals, adhesive paper labels adhesive seals and the like which once opened are substantially not reclosable without evidence of having once been opened.

Figure 7:
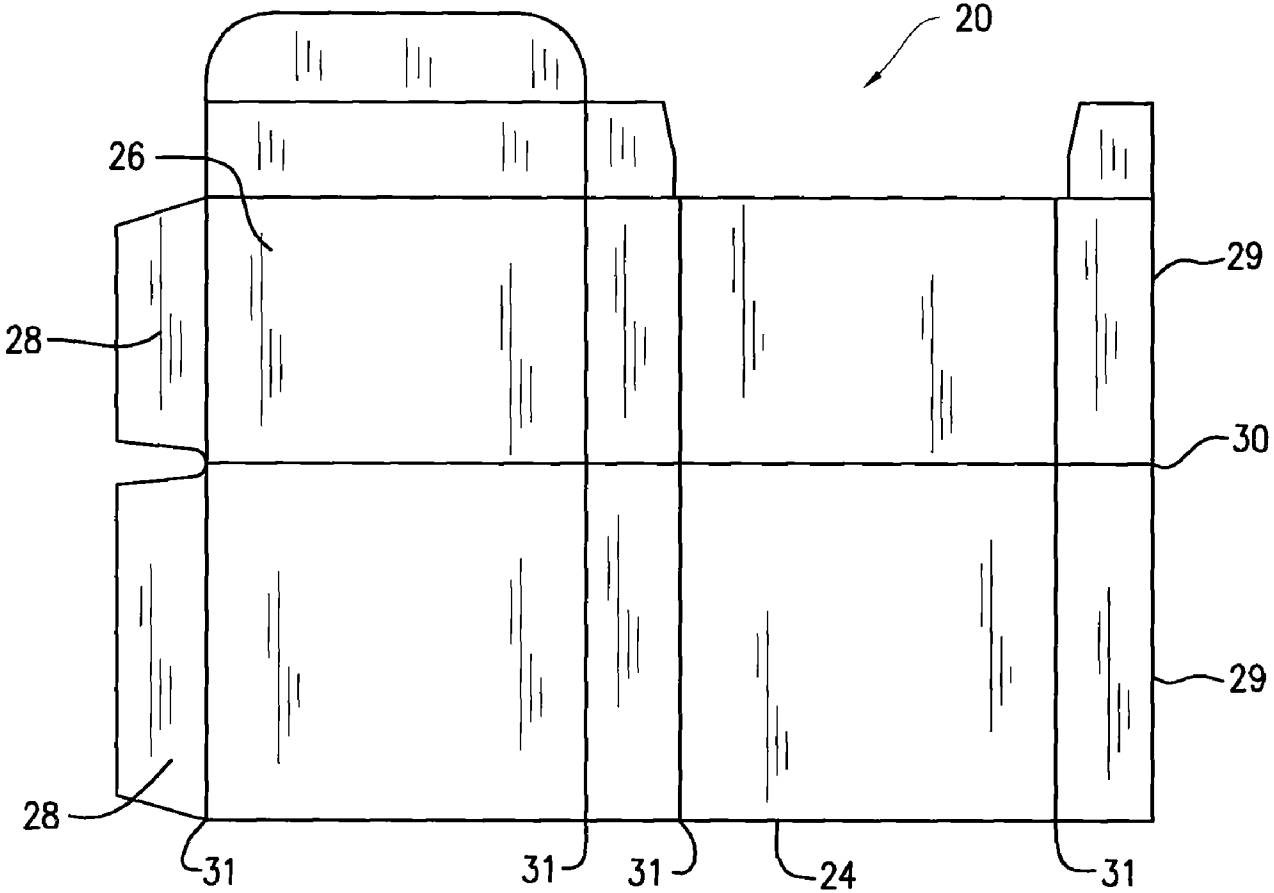
FIGS. 7 to 9 illustrate further aspects of the present invention.
Figure 8:
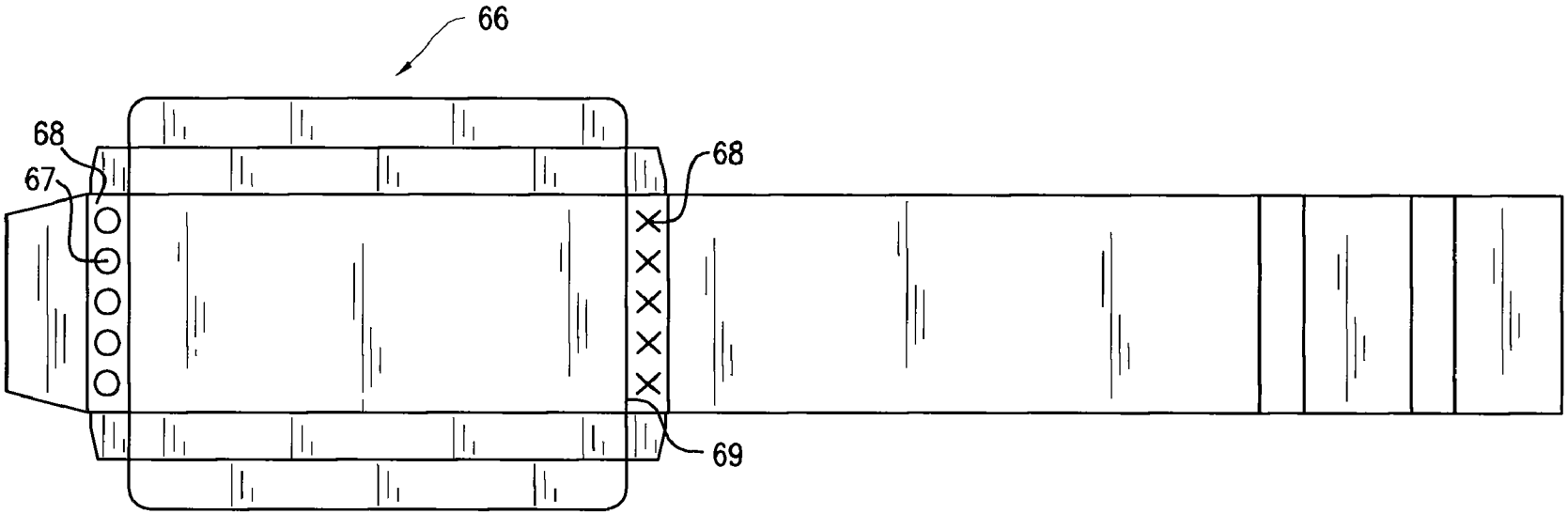
Figure 9:
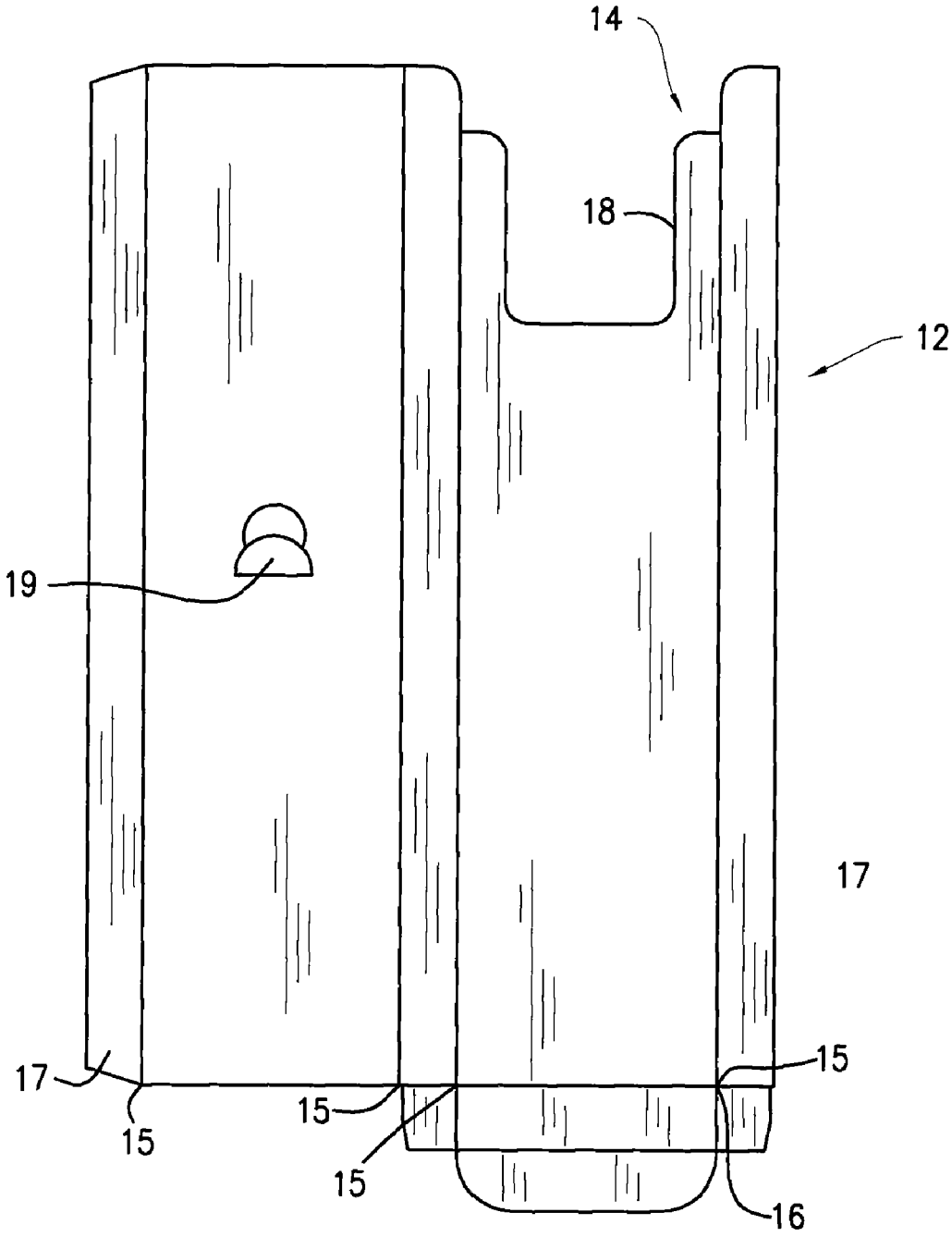

FIGS. 7 to 9 illustrate various other aspects of the present invention, including preferred dimensions. It is to be understood that various dimensions can be used with package 10 to conveniently accommodate elongate articles of varying size and be considered within the scope of the invention.

Currently available packages for such items do not evidence much thought to how practitioners of NMR analysis actually use the tubes. Package 10 provides a substantially secure and protective place to contain these somewhat fragile elongate tubes. Additionally, by being easily opened and providing the practitioners with a display stand with an elevated open end, tubes can readily be viewed, removed for sample preparation or analysis and then easily returned to a secure package.

What is claimed is:

1. A package for containing and displaying elongate articles on a horizontal surface comprising:

an elongate receptacle with an open end and a closed end;

a sleeve disposed and sized for longitudinal slidable movement over a portion of the elongate receptacle, the sleeve having an open end portion connected by a hinge to a closed end portion, the closed end portion having an open end and a closed end;

the open end portion of the sleeve being disposed outside around the elongate receptacle and slidably moveable between a first down position, wherein the closed end portion of the sleeve substantially obstructs the open end of the elongate receptacle, and a second up position wherein the hinge is slidably disposed adjacent the open end of the elongate receptacle, the closed end portion of the sleeve being selectively rotatable about the hinge, wherein when the open end portion of the sleeve is slidably returned toward the first down position, and further having been sufficiently moved down along the elongate receptacle, the open end of the closed end portion of the sleeve rests against an outside surface of the elongate receptacle thereby forming a projection from the elongate receptacle, so that when the package is placed on the horizontal surface, the closed end of the elongate receptacle and the closed end of the sleeve closed end portion rest on the horizontal surface, the open end of the elongate receptacle is elevated above the closed end of the elongate receptacle, thereby displaying and improving accessibility of the elongate articles contained within the elongate receptacle.

2. The package of claim 1 wherein the package is reversibly closable by slidably moving the sleeve from the first down position wherein the closed end portion of the sleeve rests against the outside surface of the elongate receptacle to the second up position wherein the hinge is disposed adjacent the open end of the elongate receptacle thereby allowing selective rotation of the closed end portion of the sleeve to a position along the longitudinal axis of the elongate receptacle, so that movement of the sleeve to the first down position substantially obstructs the open end of the elongate receptacle.

3. The package of claim 1 wherein the elongate receptacle comprises means for receiving and separately holding a plurality of elongate objects.

4. The package of claim 3 wherein the means for receiving and separately holding a plurality of elongate objects comprises an adapter disposed and sized to fit within the elongate receptacle having a plurality of projections thereon being sized and spaced to receive, hold and separate the elongate objects.

5. The package of claim 3 wherein the means for receiving and separately holding a plurality of elongate objects comprises a lower portion disposed at the closed end of the elongate receptacle and an upper portion disposed between the open and the closed end of the elongate receptacle, wherein at least the upper portion has a plurality of openings in substantial alignment to receive, hold and separate the elongate objects.

6. The package of claim 5 wherein the upper and lower portions are a single article of manufacture being sized and shaped to slidably fit within the elongate receptacle.

7. The package of claim 5 wherein the means for receiving and separately holding a plurality of elongate objects is fixedly attached to an inside surface of the elongate receptacle.

8. The package of claim 5 wherein the means for receiving and separately holding a plurality of elongate objects is releasably removable from the elongate receptacle.

9. The package of claim 3 wherein the means for receiving and separately holding the elongate objects is formed from a material selected from the group consisting of a polymeric material, a cellulosic material, a metallic material and composites of one or more of these materials.

10. The package of claim 9 wherein the means for receiving and separately holding the elongate objects comprises a lower portion sized to fit within the closed end portion of the elongate receptacle and an upper portion comprising a plurality of regularly spaced positions sized and spaced to individually receive and separate the elongate objects placed therewithin.

11. The package of claim 3 further comprising a plurality of NMR tubes held in place by the means for receiving and separately holding a plurality of elongate objects.

12. The package of claim 1 wherein the elongate receptacle and the sleeve are formed from a material selected from the group consisting of a polymeric material, a cellulosic material, a metallic foil material and composites of one or more of these materials.

13. The package of claim 12 wherein the elongate receptacle and the sleeve are formed from the same material.

14. The package of claim 12 wherein the elongate receptacle and the sleeve are formed from different materials.

15. The package of claim 12 wherein the elongate receptacle and the sleeve are each formed from a sheet of material, the material being cut, formed and bonded to form the elongate receptacle and the sleeve respectively.

16. The package of claim 1 wherein one or both of the elongate receptacle and the sleeve comprise decorations selected from the group consisting of labels, lithographic printing, jet printing, offset printing, debossing, embossing, foil transfer, die cutting, perforating and combinations thereof in monotone or one or more colors.

17. The package of claim 1 comprising means for tamper evidence.

18. The package of claim 17 wherein the means for tamper evidence is selected from the group consisting of a frangible material selected from the group consisting of overwrap, polymeric tape seals, foil tape seals, adhesive paper labels and combinations thereof.

19. The package of claim 1 comprising stop means for engaging the open end portion of the sleeve and defining a limit for movement to the first down position of the sleeve.

20. The package of claim 1 wherein the elongate receptacle comprises a cut-away portion to facilitate removal of the articles contained therewithin.

* * * * *